US008708330B2

(12) United States Patent
Hida

(10) Patent No.: US 8,708,330 B2
(45) Date of Patent: Apr. 29, 2014

(54) SHEET CONVEYOR APPARATUS

(71) Applicant: Tsutomu Hida, Ichinomiya (JP)

(72) Inventor: Tsutomu Hida, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/754,487

(22) Filed: Jan. 30, 2013

(65) Prior Publication Data

US 2013/0193632 A1 Aug. 1, 2013

(30) Foreign Application Priority Data

Jan. 31, 2012 (JP) ..... 2012-017759

(51) Int. Cl.
*B65H 3/06* (2006.01)

(52) U.S. Cl.
USPC ..... 271/117

(58) Field of Classification Search
USPC ..... 271/117, 118
See application file for complete search history.

(56) References Cited

U.S. PATENT DOCUMENTS 7,594,651 B2 * 9/2009 Hall et al. ..... 271/117
7,595,916 B2 9/2009 Morimoto et al.
2005/0184449 A1 8/2005 Morimoto et al.
2007/0001374 A1 * 1/2007 Lee ..... 271/117
2011/0148034 A1 * 6/2011 Inoue ..... 271/264

FOREIGN PATENT DOCUMENTS

JP 2005-231844 A 9/2005
JP 3886690 B2 2/2007
JP 2007-254146 A 10/2007

* cited by examiner

*Primary Examiner* — Michael McCullough
(74) *Attorney, Agent, or Firm* — Banner & Witcoff, Ltd.

(57) ABSTRACT

A sheet conveyor apparatus may include a sheet support portion, a first roller that feeds sheets supported on the sheet support portion, and a second roller disposed downstream of the first roller and rotatable about a rotation axis. The apparatus further include a holder supported swingably about the rotation axis, a wall opposite the sheet support portion with the holder interposed therebetween, and a pressing member disposed between the wall and the holder to press the first roller toward the sheet support portion. The pressing member includes a holding member movably supported by the holder to contact the wall, and a spring disposed between the holding member and the holder to apply a biasing force causing the holding member and the holder to move away from each other while maintaining a state in which the holding member contacts the wall regardless of swing of the holder about the rotation axis.

15 Claims, 8 Drawing Sheets

SHEET CONVEYOR APPARATUS

CROSS-REFERENCE TO RELATED APPLICATION

This application claims priority from Japanese Patent Application No. 2012-017759, filed on Jan. 31, 2012, which is incorporated herein by reference.

FIELD OF DISCLOSURE

Aspects of the present disclosure relate to a sheet conveyor apparatus.

BACKGROUND

A known sheet conveyor apparatus includes a sheet support portion where one or more sheets are held, and a first roller for feeding the sheets, which are stacked on the sheet support portion, in a sheet conveyance direction. The sheet conveyor apparatus further includes a second roller, which is disposed downstream of the first roller in the conveyance direction, which is rotatable about a rotation axis extending in a widthwise direction of the conveyed sheet, and which serves to separate plural sheets one by one, and a holder, which is supported to be swingable about a rotation axis, and which rotatably supports the first roller.

The holder includes a transmission mechanism for transmitting rotation of the second roller about the rotation axis to the first roller. The transmission mechanism includes two pulleys rotatable together with the first roller and the second roller, respectively, and a belt stretched around the two pulleys. In the sheet conveyor apparatus, a rotational speed of a motor for rotating the second roller is controlled to adjust a pressing force of the first roller against the sheet such that the sheet is fed in the conveyance direction. Furthermore, the first roller may be pressed against the sheet by the weight of the holder and the first roller.

SUMMARY

In the known sheet conveyor apparatus described above, however, because the pressing force of the first roller against the sheet is adjusted with the rotational speed of the motor, complicated control is required to reliably deliver the sheet in the conveyance direction regardless of the number of stacked sheets. Moreover, it is difficult to set the proper pressing force by utilizing the weights of the holder and the first roller.

An illustrative embodiment of the disclosure provides for a sheet conveyor apparatus in which the first roller is pressed by the pressing member against the sheet(s) stacked on the sheet support portion. At that time, the holder is caused to swing about the rotation axis, whereby the distance between the first roller and the sheet support portion is changed. As a result, the first roller contacts the uppermost sheet regardless of the number of stacked sheets.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION

Hereinafter, one or more aspects of the disclosure are described.

Figure 1:
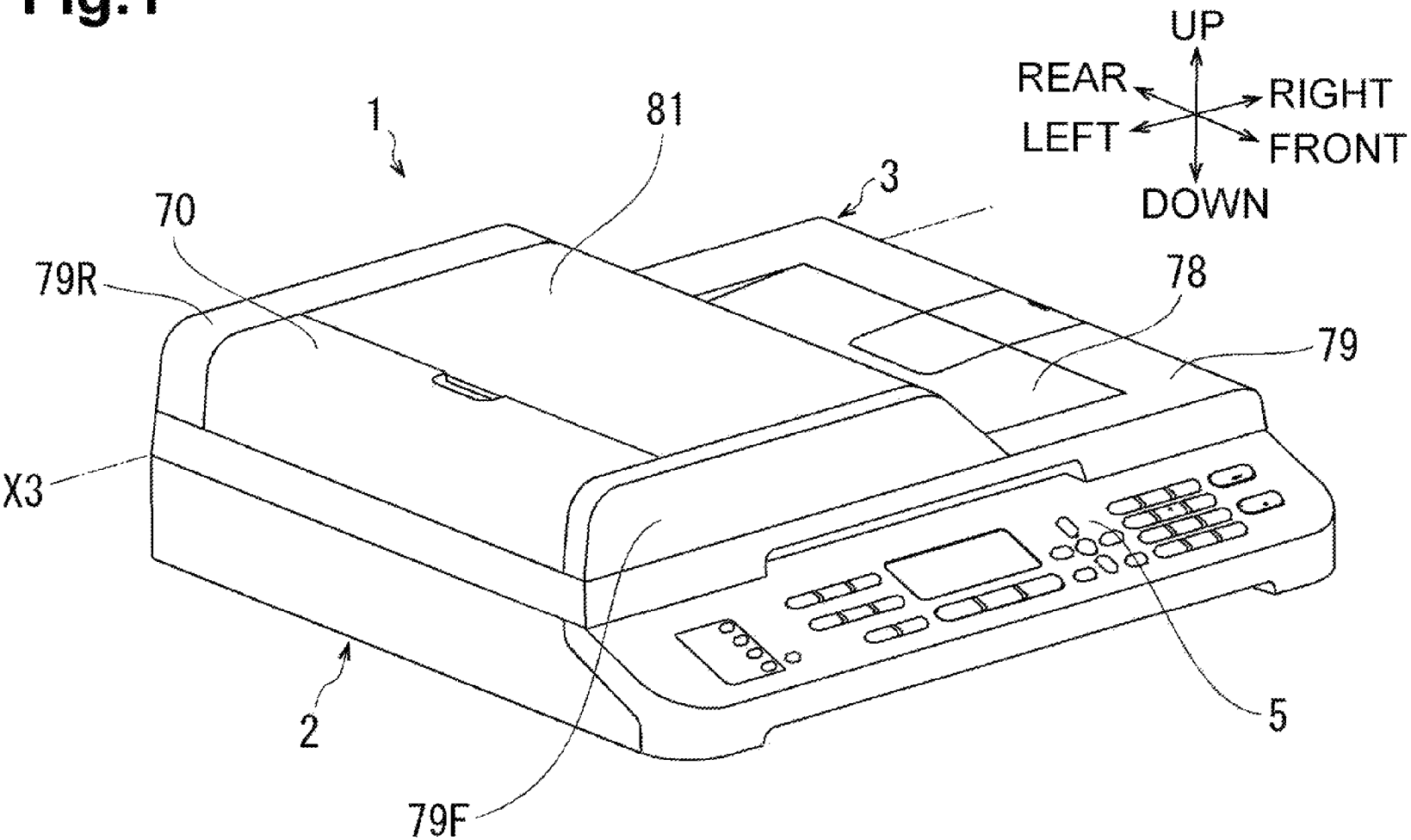
FIG. 1 is a perspective view of an image reading apparatus in an illustrative embodiment according to one or more aspects.
Figure 2:
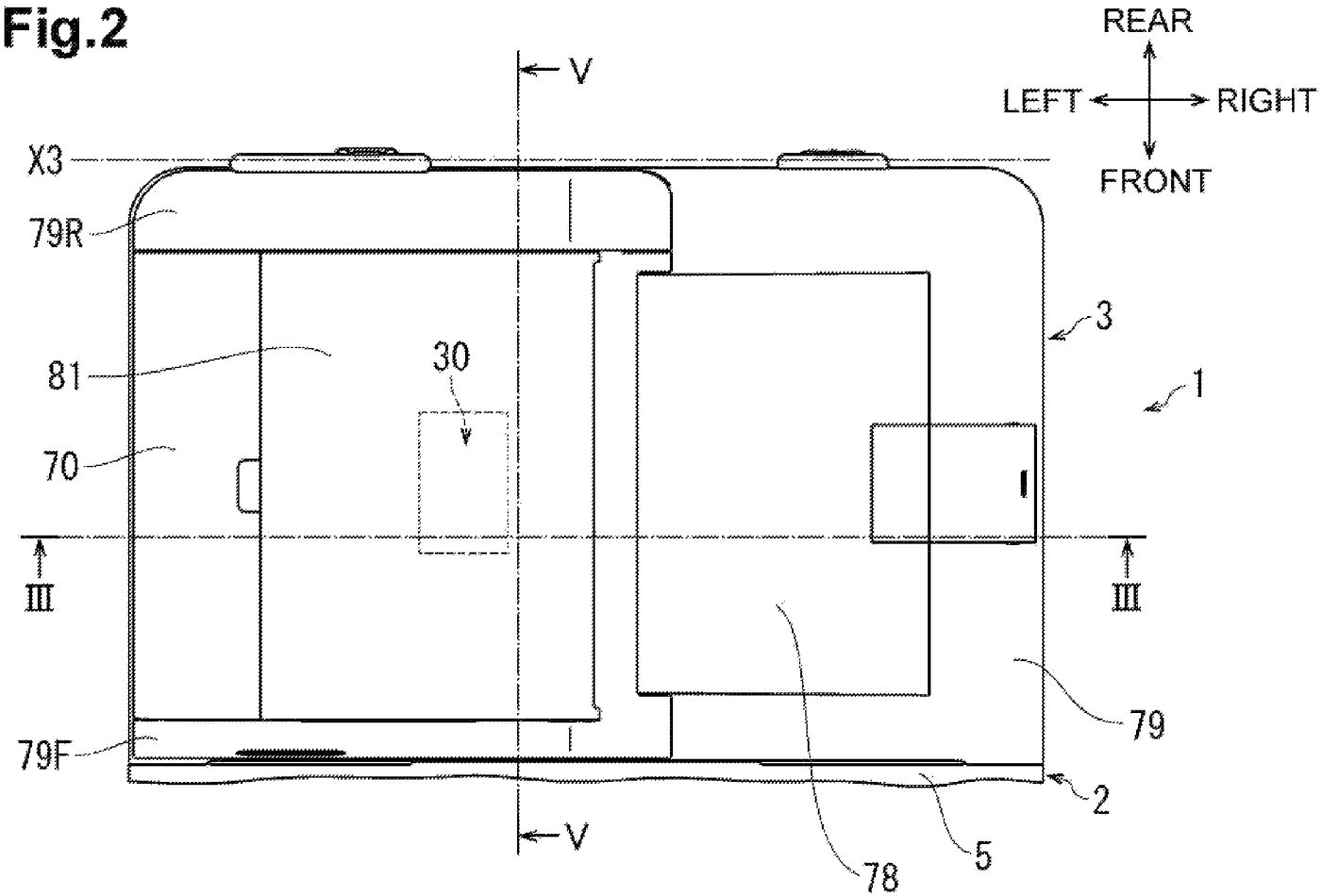
FIG. 2 is a plan view of the image reading apparatus in an illustrative embodiment according to one or more aspects.

An image reading apparatus 1 according to an illustrative embodiment, illustrated in FIG. 1, is one practical example of a sheet conveyor apparatus according to aspects of the present disclosure. In FIG. 1, front and rear directions, right and left directions, and up and down directions are represented by defining, as a "front side", the side where an operating panel 5 is disposed, and as a "left side", the side that is disposed at the left of the operating panel 5 when the operating panel 5 is viewed from the front. In FIG. 2 and the subsequent figures, directions are represented corresponding to the directions defined in FIG. 1. Individual components of the image reading apparatus 1 will be described below with reference to FIG. 1, etc.

<Construction>

Figure 3:
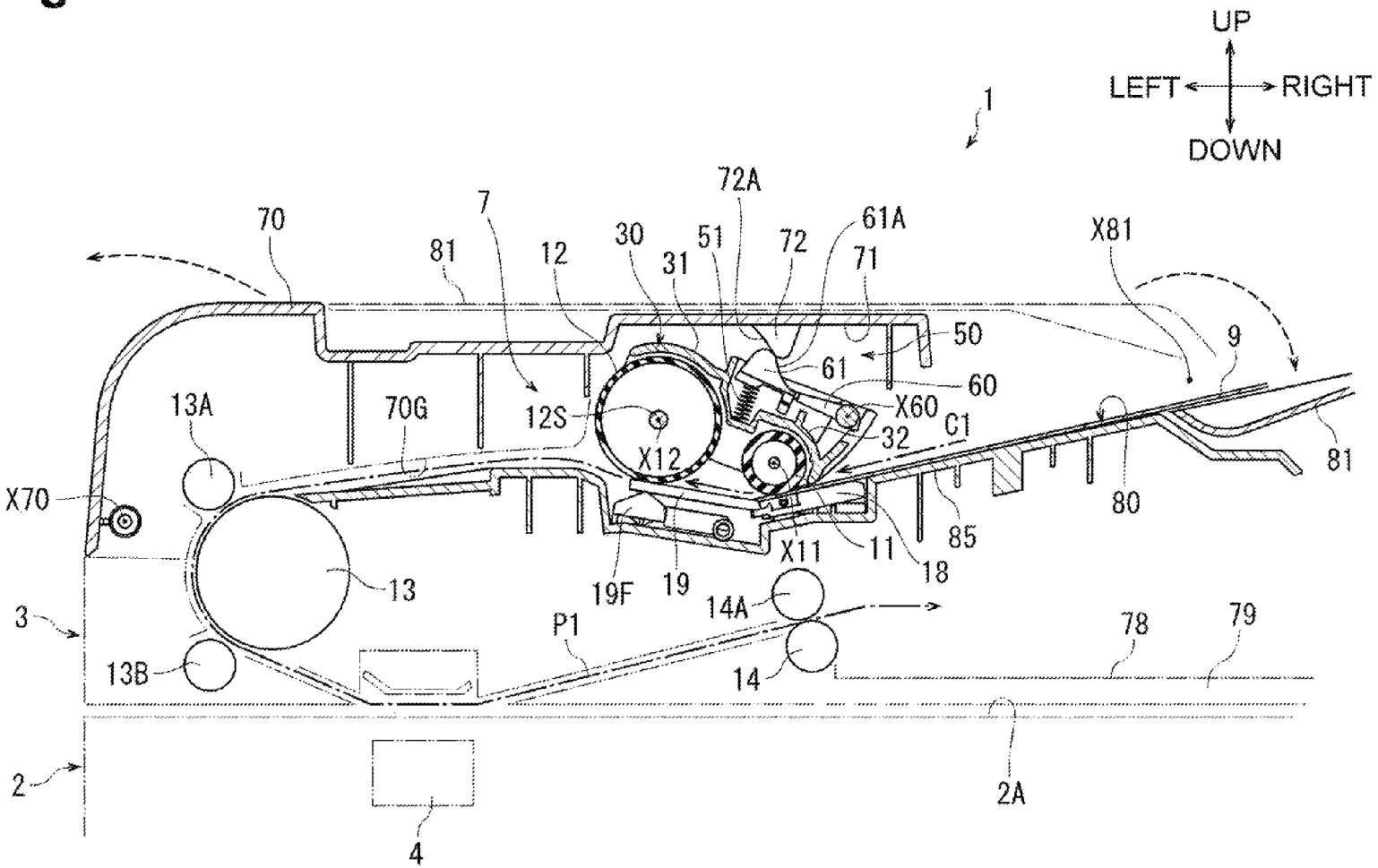
FIG. 3 is a schematic partial sectional view, taken along a section III-III in FIG. 2, of the image reading apparatus in an illustrative embodiment according to one or more aspects.

As illustrated in FIGS. 1 and 2, the image reading apparatus 1 includes a main body 2 and an opening/closing unit 3. The main body 2 is a substantially box-like flattened body with the operating panel 5 disposed at the front side thereof. As illustrated in FIG. 3, an upper surface of the main body 2 serves as a surface 2A on which a sheet (original document) is read in a stationary state. As illustrated in FIGS. 1 and 2, the opening/closing unit 3 is supported by the main body 2 to be swingable about an opening/closing axis X3. In a closed state illustrated in FIG. 1, the opening/closing unit 3 covers the surface 2A from above as illustrated in FIG. 3. Though not illustrated, the opening/closing unit 3 swings about the opening/closing axis X3 such that the front side of the opening/closing unit 3 is movable upwards, to create an open space above the surface 2A. In other words, the sheet as a reading target may be placed on the surface 2A.

As illustrated in FIG. 3, a reading unit 4 is disposed within the main body 2. A known image reading sensor, e.g., a CIS (Contact Image Sensor) or a CCD (Charge Coupled Device), is used as the reading unit 4. In the image reading apparatus 1, when the reading unit 4 reads the original document placed on the surface 2A, an image of the original document is read while the reading unit 4 moves from the left end side to the right end side within the main body 2. Furthermore, when the reading unit 4 is held in a stop position, illustrated in FIG. 3, at the left end side within the main body 2, the reading unit 4 may read an image of one or more sheets (original documents) 9 stacked on a sheet supporting portion 80, as described below, while the sheets 9 are conveyed one by one.

Figure 4:
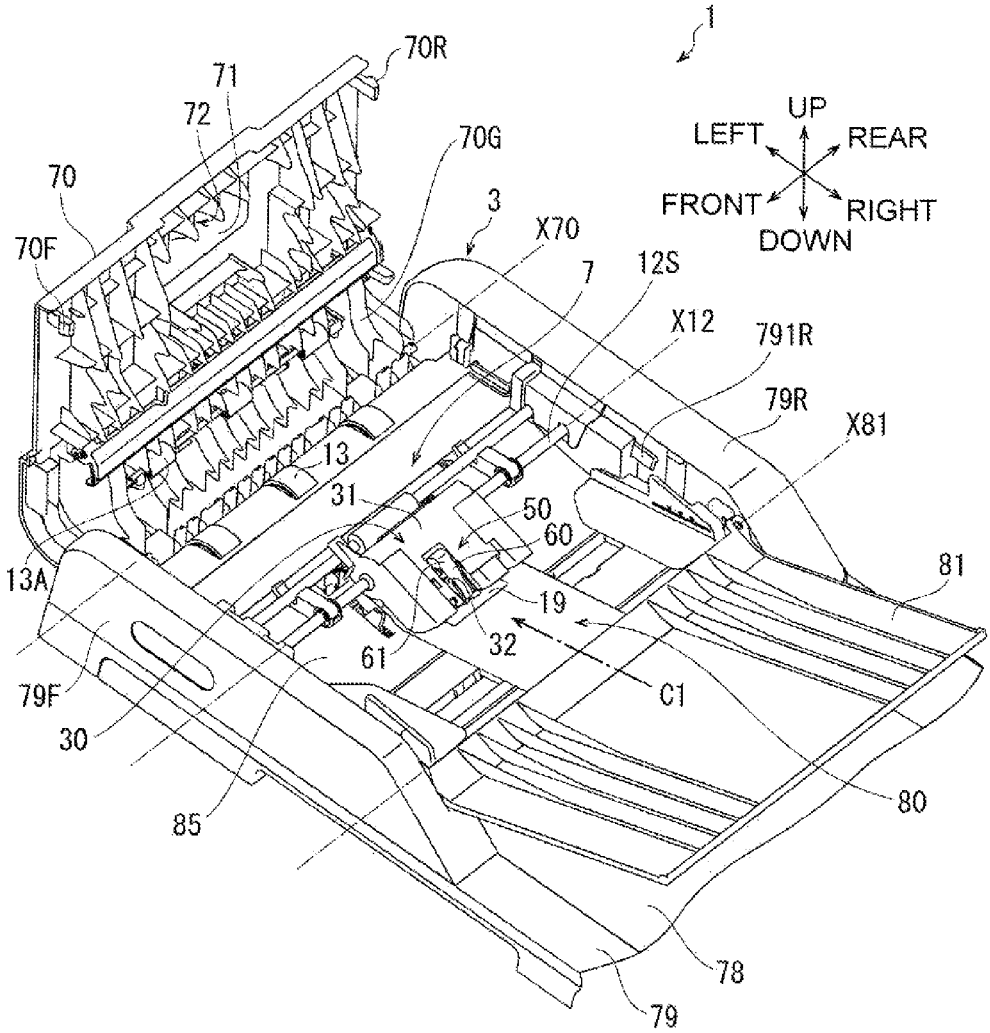
FIG. 4 is a partial perspective view of the image reading apparatus in an illustrative embodiment according to one or more aspects, the view illustrating a state where a supply tray and a cover member are opened.

As illustrated in FIGS. 3 and 4, the opening/closing unit 3 includes a base member 79, an upper chute 85, a cover member 70, and a supply tray 81.

As illustrated in FIG. 3, the base member 79 is a substantially flat member that lies over the surface 2A from above in the closed state of the opening/closing unit 3. A left-side portion of the base member 79 constitutes a guide surface at the downstream side of a conveyance path P1 (described later). A right-side portion of the base member 79 constitutes a sheet discharge portion 78 onto which the sheets 9 having been conveyed along the conveyance path P1 are discharged and stacked.

As illustrated in FIG. 4, a pair of front and rear upstanding walls 79F and 79R is disposed at the left side of the base member 79. The upstanding walls 79F and 79R are disposed respectively at the front side and the rear side of the base member 79 in a state opposed to each other and extending upwards in the form of vertical panels.

As illustrated in FIGS. 3 and 4, the upper chute 85 is a substantially flat plate member, which extends in the right and left direction from a central region closer to a center of the opening/closing unit 3 than to each end side in the right and left direction to the left end side of the opening/closing unit 3, and which is mounted at the front side and the rear side thereof to the upstanding walls 79F and 79R. The upper chute 85 is spaced upwards from the left-side portion of the base member 79. The upper chute 85 constitutes a lower guide surface at the upstream side of the conveyance path P1 (described later). A recess recessed downwards is formed at a central portion closer to a center of the upper chute 85 than to each end side in the front and rear direction and in the right and left direction. A separation pad 19, i.e., a friction member in the form of a flat plate, is disposed in the recess.

As illustrated in FIG. 3, the cover member 70 is a substantially flat plate member, which extends in the right and left direction from the central region to the left end of the opening/closing unit 3 in a state spaced upwards from the upper chute 85. The cover member 70 is bent at the left side thereof to extend downwards, and a lower end of the cover member 70 is supported by the base member 79 to be swingable about an opening/closing axis X70. Thus, the cover member 70 is movable to a closed position illustrated in FIG. 3 and to an open position illustrated in FIG. 4.

As illustrated in FIG. 4, ribs 70G extending in the right and left direction are formed on an inner surface of the cover member 70. The plural ribs 70G are arranged side by side at intervals in the front and rear direction. As illustrated in FIG. 3, when the cover member 70 is in the closed position, the ribs 70G are disposed opposite to the upper chute 85 from above, thus constituting an upper guide surface at the upstream side of the conveyance path P1 (described later).

Figure 5:
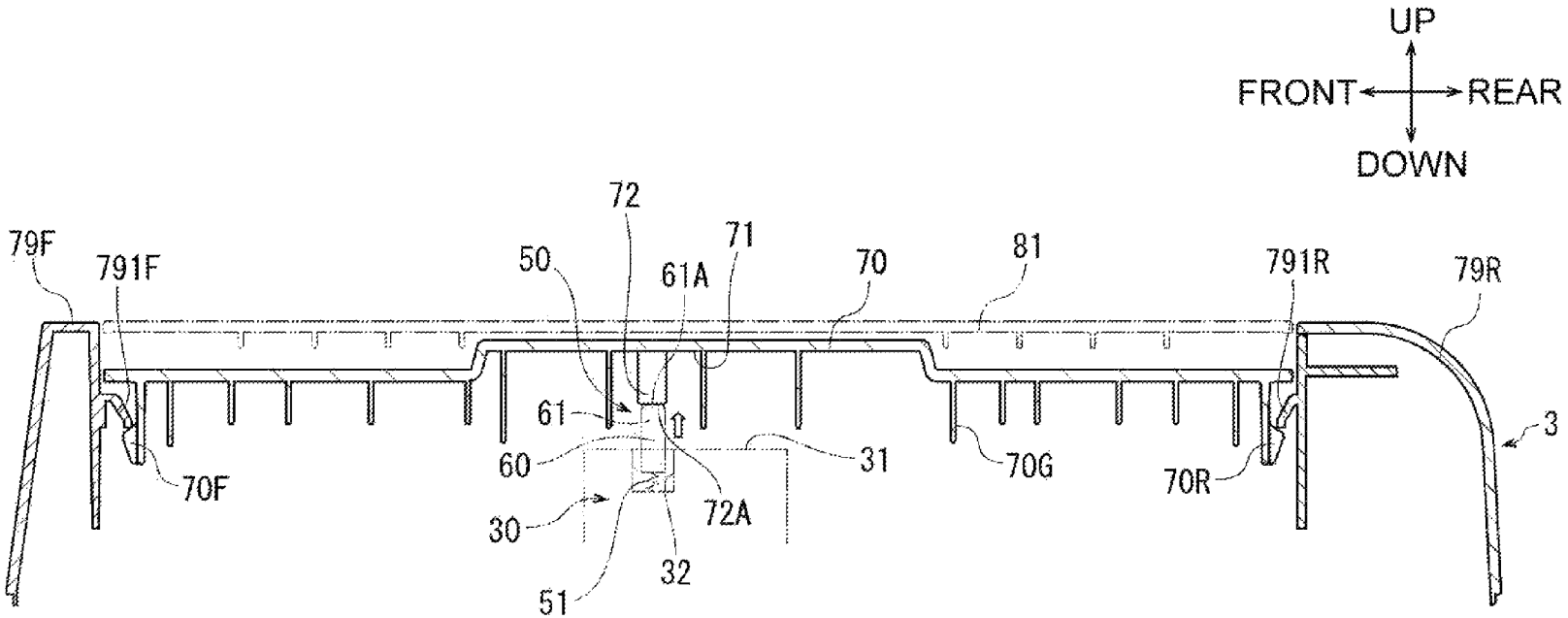
FIG. 5 is a schematic partial sectional view, taken along a section V-V in FIG. 2, of the image reading apparatus in an illustrative embodiment according to one or more aspects.

As illustrated in FIGS. 4 and 5, a pair of front and rear engagement portions 70F and 70R is disposed respectively at front and rear corners of the cover member 70 on the free end side thereof farther away from the opening/closing axis X70. The engagement portions 70F and 70R are each in the form of a hook that projects downwards when the cover member 70 is moved to the closed position.

On the other hand, the upstanding walls 79F and 79R include a pair of front and rear positioning portions 791F and 791R at positions where the positioning portions 791F and 791R are opposed to the engagement portions 70F and 70R, respectively, when the cover member 70 is moved to the closed position. The positioning portions 791F and 791R are small pieces extending obliquely downwards from inner surfaces of the upstanding walls 79F and 79R, respectively.

When the cover member 70 is moved to from the open position to the closed position, the engagement portions 70F and 70R and the positioning portions 791F and 791R are caused to slide in contact with each other while they are elastically deformed. Thereafter, as illustrated in FIG. 5, lower ends of the positioning portions 791F and 791R come into a state abutting against the engagement portions 70F and 70R and locking them, respectively. As a result, the cover member 70 is reliably disposed at the closed position.

As depicted by two-dot-chain lines in FIGS. 3 and 5, the supply tray 81 is a substantially flat plate member extending in the right and left direction from almost the center to near the left end of the opening/closing unit 3 in a state overlapped with the cover member 70 from above, which is in the closed position, when the supply tray 81 is in an unused state. Furthermore, as illustrated in FIG. 4, the supply tray 81 is supported at the right end side thereof by the upstanding walls 79F and 79R to be swingable about an opening/closing axis X81.

As illustrated in FIGS. 3 and 4, when the supply tray 81 is used, the supply tray 81 is swung about the opening/closing axis X81 to be spaced from the cover member 70. With the swing of the supply tray 81, an upwards-facing surface of the supply tray 81 forms a flat plane in continuation with an upper surface of the upper chute 85. Such a flat plane extending from the upwards-facing surface of the supply tray 81 to near the separation pad 19 in the upper surface of the upper chute 85 functions as the sheet supporting portion 80 where one or more sheets 9 are stacked. In that state, the sheet supporting portion 80 is disposed above the sheet discharge portion 78.

As illustrated in FIG. 3, a conveyor unit 7 for conveying the sheet 9 from the sheet supporting portion 80 along the conveyance path P1 and discharging the sheet 9 to the sheet discharge portion 78 is disposed within the opening/closing unit 3. Here, the conveyance path P1 is a path for conveying each of the sheets 9 stacked on the sheet supporting portion 80 to the left side along the upper surface of the upper chute 85, then changing the conveyance direction such that the sheet 9 is U-turned downwards, further conveying the sheet 9 to the right to pass above the reading unit 4 held in the stop position, and finally discharging the sheet 9 onto the sheet discharge portion 78. A conveyance direction C1 in which the sheet 9 is conveyed from the sheet supporting portion 80 is a direction toward the left from the right in the illustrative embodiment. Moreover, a widthwise direction of the conveyed sheet 9 is the front and rear direction in the illustrative embodiment.

Figure 6:
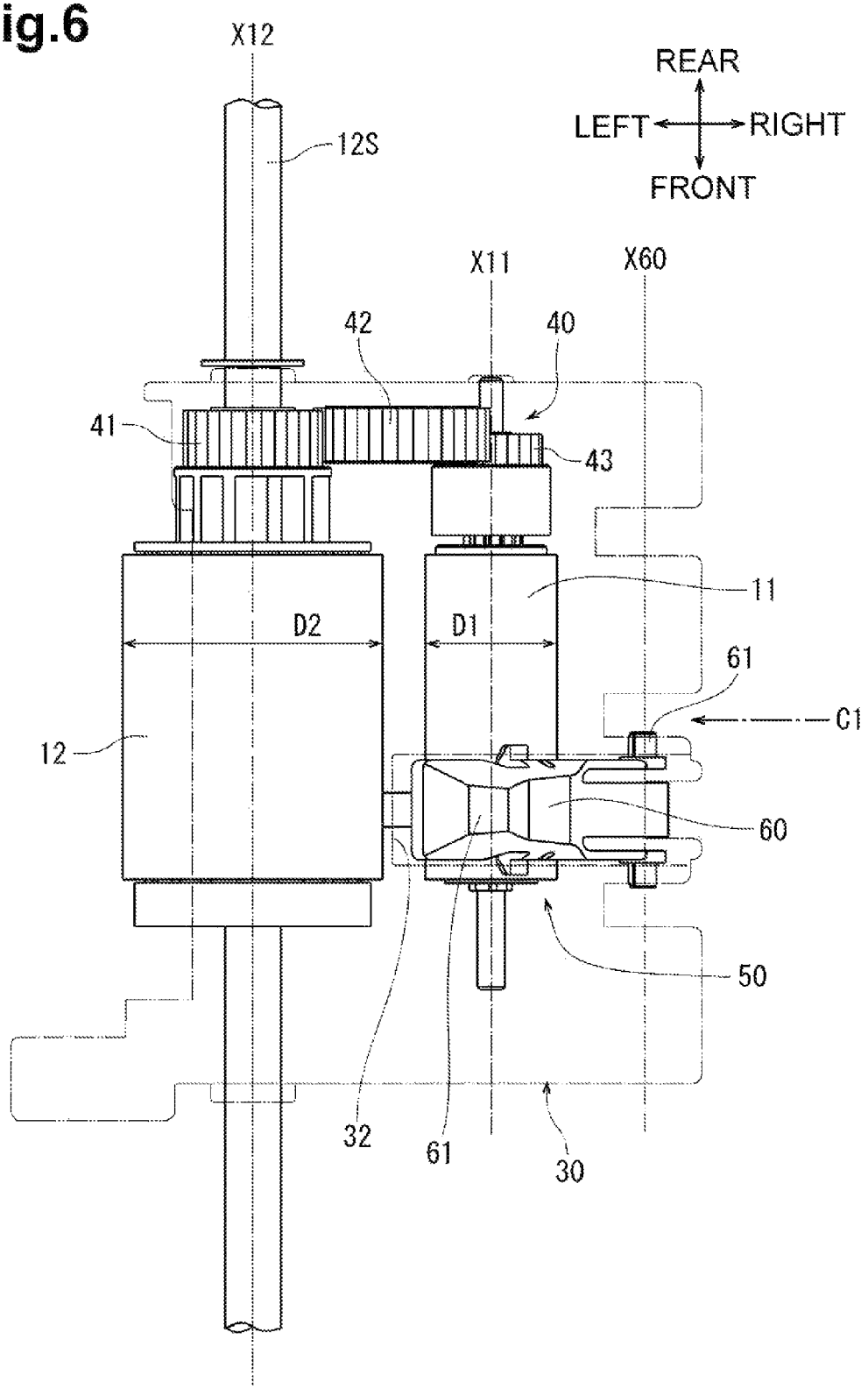
FIG. 6 is a schematic plan view of the image reading apparatus in an illustrative embodiment according to one or more aspects, the view illustrating a relative positional relationship when a rotating shaft, a first roller, a second roller, a holder, a transmission mechanism, and pressing member are viewed from above.

As illustrated in FIGS. 3, 4 and 6, the conveyor unit 7 includes a rotating shaft 12S, a second roller 12, the separation pad 19, a holder 30, a first roller 11, a transmission mechanism 40, and pressing member 50. The conveyor unit 7 further includes, as illustrated in FIG. 3, a third roller 13, a fourth roller 14, and driven rollers 13A, 13B and 14A. Respective surfaces of the upper chute 85 and the base member 79, which are disposed between adjacent twos of the first to fourth rollers 11 to 14 and the driven rollers 13A, 13B and 14A, also guide the conveyance of the sheet 9 and function as part of the conveyance unit 7.

As illustrated in FIGS. 3 and 4, the rotating shaft 12S is a cylindrical shaft member extending with its axis defined as a rotation axis X12 extending in the front and rear direction. Front and rear ends of the rotating shaft 12S are rotatably supported by the upstanding walls 79F and 79R, respectively. When the sheets 9 stacked on the sheet supporting portion 80 are each conveyed along the conveyance path P1, the rotating shaft 12S is rotated clockwise, looking at the drawing sheet of FIG. 3 from the front, by a driving unit (not illustrated).

As illustrated in FIGS. 3 and 6, the second roller 12 is fixed to a central portion of the rotating shaft 12S in the front and rear direction. Thus, the second roller 12 is rotatable together with the rotating shaft 12S about the rotation axis X12.

As illustrated in FIG. 3, the second roller 12 is disposed opposite to the separation pad 19, which is disposed in the upper chute 85, from above. The separation pad 19 is pressed against the second roller 12 by biasing member 19F disposed between the separation pad 19 and the upper chute 85.

As illustrated in FIGS. 3, 4 and 6, the holder 30 is supported by the rotating shaft 12S to be swingable about the rotation axis X12 in such a state that the holder 30 sandwiches the second roller 12 from the front and rear sides. The holder 30 extends toward the upstream side of the rotating shaft 12S in the conveyance direction C1, i.e., toward the right side.

As illustrated in FIGS. 3 and 6, the first roller 11 is disposed on the right side of the second roller 12 and is supported by the holder 30 to be rotatable about a rotation axis X11 that is parallel to the rotation axis X12. In other words, the second roller 12 is disposed downstream of the first roller 11 in the conveyance direction C1. As illustrated in FIG. 6, an outer diameter D1 of the first roller 11 is set to be smaller than an outer diameter D2 of the second roller 12.

As illustrated in FIGS. 3 and 4, the holder 30 includes an upper wall 31 that covers the first roller 11 and the second roller 12 from above. A recess 32 is disposed above the first roller 11 and is formed to recess downward in the upper wall 31. The recess 32 is formed by utilizing an open space created above the first roller 11 due to the above-mentioned setting that the outer diameter D1 of the first roller 11 is smaller than the outer diameter D2 of the second roller 12.

As illustrated in FIG. 6, the transmission mechanism 40 is disposed in the holder 30, and includes three gears 41, 42 and 43. The gear 41 is fixed to the rear end side of the second roller 12 to be rotatable together. The gear 43 is fixed to the rear end side of the first roller 11 to be rotatable together. The gear 42 is rotatably supported by the holder 30 and is meshed with the gear 41 and the gear 43.

When the rotating shaft 12S is rotated by the driving unit (not illustrated), the transmission mechanism 40 transmits torque (rotational force) of the rotating shaft 12S to the first roller 11 through the gears 41, 42 and 43, thereby rotating the first roller 11 and the second roller 12 synchronously. At that time, because a force causing the holder 30 to follow the rotation of the rotating shaft 12S due to, e.g., not only frictional resistance between the rotating shaft 12S and the holder 30, but also frictional resistance generated upon the gears 41, 42 and 43 rotating with meshing therebetween, acts on the holder 30, the holder 30 is biased so as to swing about the rotation axis X12 in the same direction as the rotating direction of the second roller 12. As a result, the first roller 11 supported by the holder 30 is pressed toward the sheet supporting portion 80. Additionally, in the example illustrated in FIG. 3, a support member 18 is disposed between the first roller 11 and the upper chute 85 (sheet supporting portion 80). The support member 18 supports a film for preventing the occurrence of abnormal noise during the rotation of the first roller 11, and further an opposing roller for suppressing wear of the first roller 11. The support member 18 is mounted to the upper chute 85.

As illustrated in FIGS. 3, 4 and 6, the pressing member 50 is disposed between a wall 71, which is a part of the cover member 70, and the holder 30. More specifically, the wall 71 extends substantially horizontally in the cover member 70 and is disposed above the holder 30 when the cover member 70 is in the closed position. The wall 71 is disposed opposite to the sheet supporting portion 80 with the holder 30 is disposed therebetween.

The pressing member 50 includes a holding portion 60 and a spring 51.

The holding member 60 is a member extending in the right and left direction above the holder 30. As illustrated in FIG. 6, the holding member 60 includes at the right end side thereof a shaft 61B projecting in the front and rear direction. The shaft 61B is supported to be swingable by bearings (not illustrated), which are disposed in the recess 32 of the holder 30. Thus, the holding member 60 is supported by the holder 30 to be swingable about a swing axis X60 such that the left end side of the holding member 60 may be moved up and down to come into contact with the wall 71. The swing axis X60 is disposed at the side closer to the first roller 11 than to the second roller 12.

The spring 51 is a compression coil spring. A lower end of the spring 51 is secured to the bottom of the recess 32, and an upper end of the spring 51 is secured to the left end side of the holding member 60 from below. Thus, the spring 51 is disposed between the holding member 60 and the holder 30, to thereby produce a biasing force acting to make the holding member 60 and the holder 30 apart from each other.

A first contact portion 61 projecting toward the wall 71 is provided at the left end side of the holding member 60. An upper end of the first contact portion 61 is formed as a curved surface bulging upwards. The right side of the curved surface of the first contact portion 61 is formed as a sloped surface that is down-sloped while recessing downwards. The curved surface and the sloped surface jointly constitute a first contact surface 61A of the first contact portion 61.

A second contact portion 72 projecting toward the sheet supporting portion 80 (toward the holder 30) is provided on the wall 71. A lower end of the second contact portion 72 is formed as a curved surface bulging downwards. The left side of the curved surface of the second contact portion 72 is formed as a sloped surface that is up-sloped while recessing upwards. The curved surface and the sloped surface jointly constitute a second contact surface 72A of the second contact portion 72.

As illustrated in FIG. 5, the first contact portion 61 and the second contact portion 72 are disposed between both the positioning portions 791F and 791R in the front and rear direction, and are opposed to each other in the up and down direction.

Figure 7A:
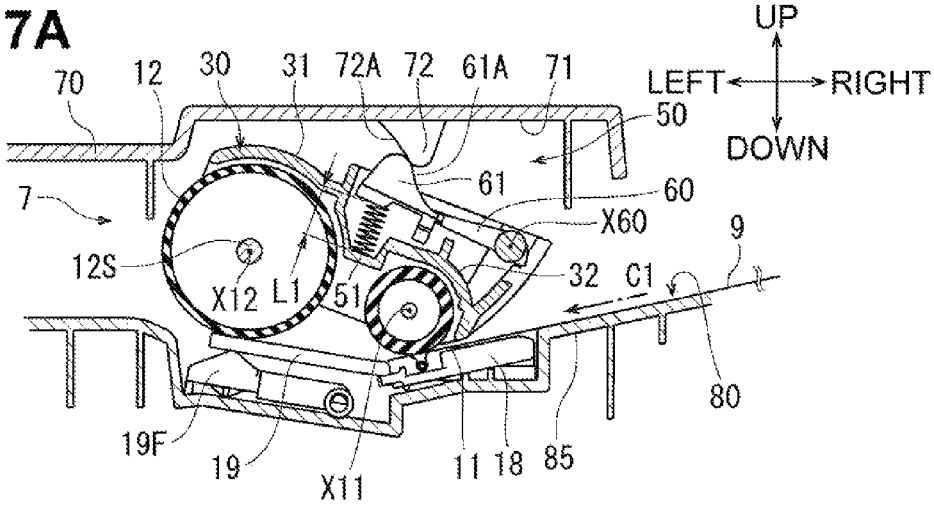
FIGS. 7A, 7B and 7C are each a partial sectional view, similar to FIG. 3, of the image reading apparatus in an illustrative embodiment according to one or more aspects, the view illustrating the holder and the first roller, which swing depending on the number of stacked sheets, and the pressing member for pressing the first roller toward the sheet support portion side.
Figure 7B:
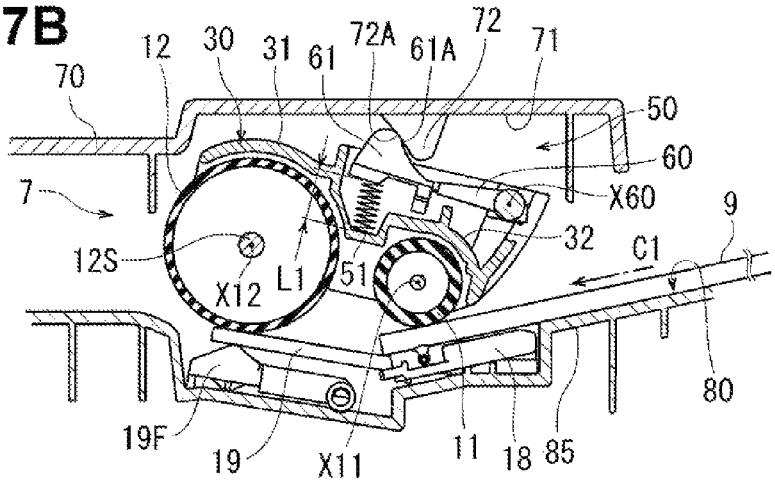
Figure 7C:
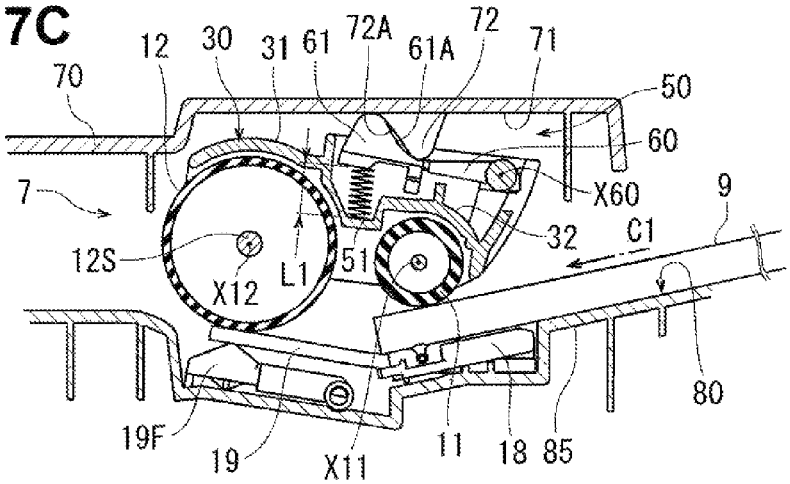

When the number of sheets 9 stacked on the sheet supporting portion 80 increases and decreases such as represented by one as illustrated in FIG. 7A, twenty-five as illustrated in FIG. 7B, and fifty as illustrated in FIG. 7C, the holder 30 is caused to swing about the rotation axis X12, thereby changing the distance between the first roller 11 and the sheet supporting portion 80. Thus, the first roller 11 is contacted with the uppermost sheet 9 regardless of the number of stacked sheets 9.

Furthermore, when the number of sheets 9 stacked on the sheet supporting portion 80 increases and decreases as illustrated in FIGS. 7A to 7C, the swing axis X60 is also caused to swing about the rotation axis X12 of the holder 30, thereby changing the relative positional relationship between the first contact surface 61A and the second contact surface 72A. At that time, as illustrated in FIGS. 7A to 7C, for example, the spring 51 develops the biasing force acting to make the holding member 60 and the holder 30 apart from each other, thereby holding the first contact surface 61A in slide contact with the second contact surface 72A and maintaining the slide contact state therebetween regardless of the swing of the holder about the rotation axis X12 of the holder 30.

Since, in the illustrative embodiment, the first contact surface 61A and the second contact surface 72A have the above-described shapes and they slide in contact with each other as illustrated in FIGS. 7A to 7C, for example, a length L1 of the spring 51 is kept constant regardless of the swing of the holder about the rotation axis X12 of the holder 30. In the illustrative embodiment, a natural length of the spring 51 is 10.7 mm, and the length L1 in a compressed state is kept constant at 8.1 mm. Such a dimension may be set, for example, in a design stage through the steps of displacing a swing angle of the holder 30 about the rotation axis X12 little by little, and then bulging or recessing at least one of the first contact surface 61A and the second contact surface 72A for each movement. By keeping the length of the spring 51 constant as described above, a pressing force applied to the sheet 9 on the sheet supporting portion 80 from the first roller 11 may be kept constant. Such a point will be described in detail later.

As illustrated in FIGS. 3 and 4, the third roller 13 is a large-diameter roller disposed at an edge of the upper chute 85 on the left end side. Thus, inside the downward U-turned portion of the conveyance path P1, the third roller 13 is rotated in synchronism with the first roller 11 and the second roller 12. The driven rollers 13A and 13B are pressed against the third roller 13 from the outer side of the downward U-turned portion of the conveyance path P1.

The fourth roller 14 is disposed on the base member 79 at the left side of the sheet discharge portion 78. Thus, at the most downstream side of the conveyance path P1, the fourth roller 14 is rotated in synchronism with the first roller 11, the second roller 12, and the third roller 13. The driven roller 14A is pressed against the fourth roller 14 from the upper outer side at the most downstream side of the conveyance path P1.

<Automatic Reading Operation for Sheet on Sheet Supporting Portion>

In the image reading apparatus 1 having the above-described construction, images of the sheets 9 stacked on the sheet supporting portion 80 are successively read as follows.

First, as illustrated in FIGS. 7A to 7C, a user puts one or more sheets 9 on the sheet supporting portion 80 and inserts a leading edge of the one or more sheets 9 to a position under the first roller 11. Responsively, the first roller 11 is pushed up by the leading edge of the one or more sheets 9, thus causing the holder 30 to swing upwards about the rotation axis X12.

For example, when the number of stacked sheets 9 is one as illustrated in FIG. 7A, the swing axis X60 of the holding member 60 is in the lowermost position. Therefore, the entirety of the holding member 60 is spaced away from the wall 71 to the lowermost position in a sloped state. At that time, the upper side (vicinity of an apex) of the first contact surface 61A and the lower side (vicinity of an apex) of the second contact surface 72A are contacted with each other by the biasing force of the spring 51. By a reaction force generated with that contact, the first roller 11 supported by the holder 30 is pressed toward the sheet supporting portion 80. In the illustrative embodiment, the length L1 of the spring 51 in that state is the length L1 of 8.1 mm compressed from the natural length of 10.7 mm.

As another example, when the number of stacked sheets 9 is twenty-five as illustrated in FIG. 7B, the swing axis X60 of the holding member 60 is moved to an upper level than that in the case of FIG. 7A corresponding to a total thickness of the sheets 9. Therefore, the entirety of the holding member 60 comes closer to the wall 71. At that time, the vicinity of the apex of the first contact surface 61A and an intermediate portion of the second contact surface 72A are contacted with each other by the biasing force of the spring 51. By a reaction force generated with that contact, the first roller 11 supported by the holder 30 is pressed toward the sheet supporting portion 80. The length L1 of the spring 51 in that state is not changed from the length L1 in the case of FIG. 7A in accordance with the shapes of the first contact surface 61A and the second contact surface 72A, and it is maintained at the constant length of 8.1 mm.

As still another example, when the number of stacked sheets 9 is fifty as illustrated in FIG. 7C, the swing axis X60 of the holding member 60 is moved to an even upper level than that in the case of FIG. 7B corresponding to a total thickness of the sheets 9. Therefore, the entirety of the holding member 60 takes a substantially horizontal posture and comes closest to the wall 71. At that time, the upper side (vicinity of the apex) of the first contact surface 61A and the upper side of the second contact surface 72A (its portion near the wall 71) are contacted with each other by the biasing force of the spring 51. By a reaction force generated with that contact, the first roller 11 supported by the holder 30 is pressed toward the sheet supporting portion 80. The length L1 of the spring 51 in that state is also not changed from the length L1 in the case of FIG. 7A in accordance with the shapes of the first contact surface 61A and the second contact surface 72A, and it is maintained at the constant length of 8.1 mm.

Thus, the contact position between the upper side (vicinity of the apex) of the first contact surface 61A and the second contact surface 72A gradually shafts depending on the number of stacked sheets 9 such that the length L1 of the spring 51 is kept constant. Stated another way, the surface shape of the first contact surface 61A and the surface shape of the second contact surface 72A are formed such that the length L1 of the spring 51 is kept constant. It is to be noted that a change pattern where the length L1 of the spring 51 is kept constant is one example of a "particular change pattern" in the present disclosure.

As a result, the pressing member 50 presses the first roller 11 toward the sheet supporting portion 80 regardless of the swing of the holder about the rotation axis X12 of the holder 30, i.e., regardless of the number of sheets 9 stacked on the sheet supporting portion 80. On that occasion, since the biasing force of the spring 51 may be maintained constant, the pressing force applied to the sheet(s) 9 by the pressing member 50 is not changed.

In the image reading apparatus 1 constructed as described above, when the image reading apparatus 1 starts the automatic reading operation upon the user manipulating the operating panel 5, the driving unit (not illustrated) is operated to rotate the rotating shaft S12 and the second roller 12. With that rotation, the torque of the rotating shaft S12 is transmitted to the first roller 11 through the transmission mechanism 40, whereby the first roller 11 is rotated in synchronism with the second roller 12. At that time, the first roller 11 supported by the holder 30 is further pressed toward the sheet supporting portion 80 by the force causing the holder 30 to follow the rotation of the rotating shaft 12S. Thus, since the first roller 11 is reliably pressed against the sheet(s) 9 on the sheet supporting portion 80 regardless of the number of stacked sheets 9 by both the pressing force of the pressing member 50 and the force causing the holder 30 to follow the rotation of the rotating shaft 12S, the frictional force acting between the first roller 11 and the sheet 9 on the sheet supporting portion 80 may reliably be increased to a level sufficient for delivering the sheet 9, and the sheet 9 may reliably be delivered in the conveyance direction C1.

The constant pressing force is applied to the first roller 11 by the pressing member 50 to act on the sheet 9, and the sheet 9 delivered by the first roller 11 in that state passes between the second roller 12 and the separation pad 19. At that time, if plural sheets 9 are conveyed in an overlapped state, those sheets 9 are separated one by one by both the conveyance force of the second roller 12 and the frictional force generated with the separation pad 19.

The third roller 13 and the fourth roller 14 are also rotated in synchronism with the rotating shaft S12, etc. Furthermore, the third roller 13 causes each of the sheets 9 separated one by one by the second roller 12 to U-turn downwards and to pass above the reading unit 4 disposed at the stop position. At that timing, the reading unit 4 reads an image of the sheet 9. The sheet 9 after the reading of the image is discharged onto the sheet discharge portion 78 by the fourth roller 14. Such a series of operations are repeated until no sheets 9 exist on the sheet supporting portion 80.

<Operating Advantageous Effect>

In the image reading apparatus 1 according to the illustrative embodiment, the spring 51 of the pressing member 50 develops the biasing force acting to space the holding member 60 and the holder 30 from each other. Moreover, the spring 51 maintains the state where the first contact surface 61A of the holding member 60 is contacted with the second contact surface 72A of the wall 71, regardless of the swing of the holder 30 about the rotation axis X12. Accordingly, the pressing member 50 presses the first roller 11, which is supported by the holder 30, toward the sheet supporting portion 80 regardless of the swing of the holder 30 about the rotation axis X12. In addition, the first roller 11 is pressed against the sheet 9 by not only the pressing member 50, but also the force causing the holder 30 to follow the rotation of the rotating shaft 12S. As a result, in the image reading apparatus 1, the frictional force acting between the first roller 11 and the uppermost sheet 9 may reliably be increased to a level sufficient for feeding the sheet 9 regardless of the number of stacked sheets 9.

Furthermore, in the image reading apparatus 1, the spring 51 may develop a stronger biasing force than that obtained with the construction just utilizing the own weight of the holder 30 and the first roller 11. In addition, the image reading apparatus (sheet conveyor apparatus) 1 may easily adjust the pressing force applied to the sheet 9 from the first roller 11 by optionally setting the biasing force of the spring 51. Therefore, control required in the image reading apparatus 1 is not as complex as required in the above-described known sheet conveyor apparatus in which the pressing force applied to the sheet from the first roller is adjusted with the rotational speed of the motor.

With the image reading apparatus 1 according to the embodiment, therefore, the sheet 9 may reliably be conveyed from the sheet supporting portion 80, and stable sheet conveyance may be realized with the simple construction utilizing the spring 51.

With the image reading apparatus 1, since the right end side of the holding member 60 is supported by the holder 30 to be swingable about the swing axis X60 and the other end side of the holding member 60 is contacted with the wall 71, a movement stroke of the first contact portion 61 of the holding member 60 may easily be set longer. Therefore, the spring 51 may reliably maintain the state where the first contact portion 61 of the holding member 60 is contacted with the second contact portion 72 of the wall 71 regardless of the swing of the holder 30 about the rotation axis X12. Consequently, the image reading apparatus 1 may more reliably convey the sheet 9 from the sheet supporting portion 80.

With the image reading apparatus 1, because of having the construction that the swing axis X60 is disposed at the side closer to the first roller 11, the recess 32, the holding member 60, the shaft 61B, the bearings (not illustrated) for supporting the shaft 61B, etc. may be disposed by utilizing a space that is secured between the first roller 11 and the wall 71 so as to allow the swing of the holder 30 about the rotation axis X12. Hence the apparatus size may be easily reduced. In particular, in comparison with the case where the swing axis X60 is disposed closer to the rotation axis X12, the spacing between the wall 71 and the holder 30 may more easily be reduced, thus facilitating reduction of the apparatus height.

With the image reading apparatus 1, because of having the construction that the outer diameter D1 of the first roller 11 is smaller than the outer diameter D2 of the second roller 12, a larger space may be secured between the first roller 11 and the wall 71, thus increasing the degree of freedom in layout of the recess 32, the holding member 60, the shaft 61B, the bearings (not illustrated) for supporting the shaft 61B, etc. Moreover, in comparison with the case where the outer diameter D1 of the first roller 11 is larger than the outer diameter D2 of the second roller 12, the spacing between the wall 71 and the holder 30 may be more easily reduced, and reduction of the apparatus height may be facilitated.

With the image reading apparatus 1, since the first contact surface 61A and the second contact surface 72A have the above-described shapes and the first contact surface 61A is caused to slide in contact with the second contact surface 72A corresponding to the swing of the holder 30 about the rotation axis X12, the length L1 of the spring 51 may be maintained constant regardless of the number of stacked sheets 9. With the image reading apparatus 1, therefore, the biasing force of the spring 51 may be maintained constant regardless of the number of stacked sheets 9, whereby the pressing force of the pressing member 50 against the sheet 9 is not changed. As a result, with the image reading apparatus 1, the frictional force acting between the first roller 11 and the uppermost sheet 9 may be maintained constant regardless of the number of stacked sheets 9, and the sheet 9 may more reliably be conveyed from the sheet supporting portion 80.

With the image reading apparatus 1, when jamming of the sheet 9 occurs near the first roller 11 and the second roller 12, for example, the first roller 11, the second roller 12, and the holder 30 may be exposed to an open space by displacing the cover member 70 to the open position as illustrated in FIG. 4. It is, therefore, easier to remove the sheet 9 having jammed near, e.g., the first roller 11 and the second roller 12. Moreover, since the wall 71 is formed in the cover member 70, the number of parts may be reduced in comparison with that required when the wall 71 is disposed separately from the cover member 70. As a result, the image reading apparatus 1 may positively realize reduction of the manufacturing cost.

With the image reading apparatus 1, because of having the construction that the pressing member 50 is disposed between both the positioning portions 791F and 791R in the front and rear direction as illustrated in FIG. 5, the wall 71 is reliably held by both the positioning portions 791F and 791R even when the second contact portion 72 of the wall 71 is pressed against the first contact portion 61. Hence the cover member 70 is less apt to flex. As a result, the pressing force of the pressing member 50 may be caused to reliably act on the first roller 11. In particular, since the cover member 70 is reliably disposed by both the positioning portions 791F and 791R, the relative positional relationship between the first contact portion 61 and the second contact portion 72 may always be kept stable. Consequently, the image reading apparatus 1 may reliably ensure the slide contact between the first contact surface 61A and the second contact surface 72A.

FIG. 8 illustrates an image reading apparatus of a comparative example. The image reading apparatus of the comparative example differs from the image reading apparatus 1 of the illustrative embodiment in that the second contact portion 72 is omitted, and that a first contact portion 161 having a shape slightly modified from the shape of the first contact portion 61 is just disposed at the left end side of the holding member 60. Generally, the spring 51 in the form of a compressed coil spring has a difficulty in developing a strong biasing force over an entire expansion and contraction stroke while ensuring a long expansion and contraction stroke. In the image reading apparatus of the comparative example, therefore, the pressing member 50 acts, for example, as follows.

Figure 8A:
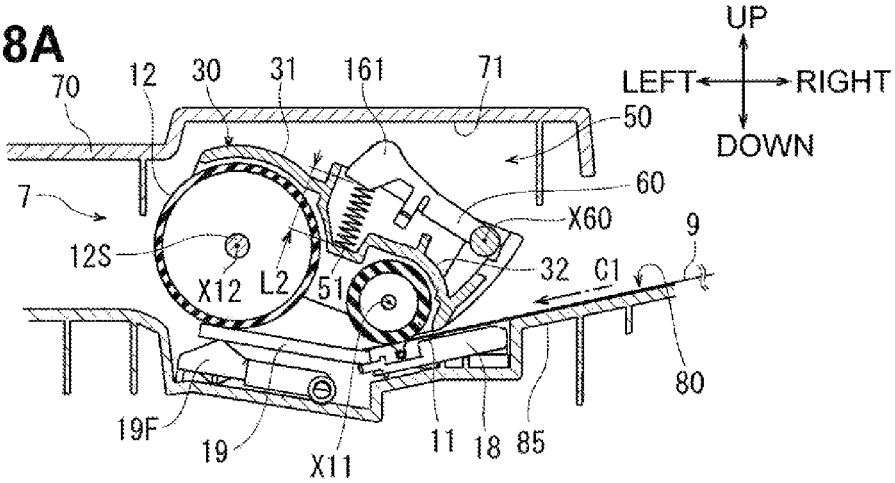
FIGS. 8A, 8B and 8C are each a partial sectional view, similar to FIG. 3, of an image reading apparatus in an illustrative embodiment according to one or more aspects of a comparative example, the view illustrating a holder and a first roller, which swing depending on the number of stacked sheets, and pressing member for pressing the first roller toward the sheet support portion side.
Figure 8B:
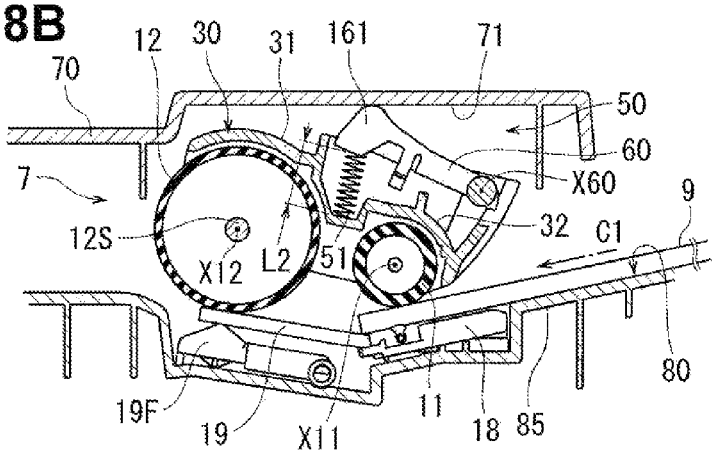
Figure 8C:
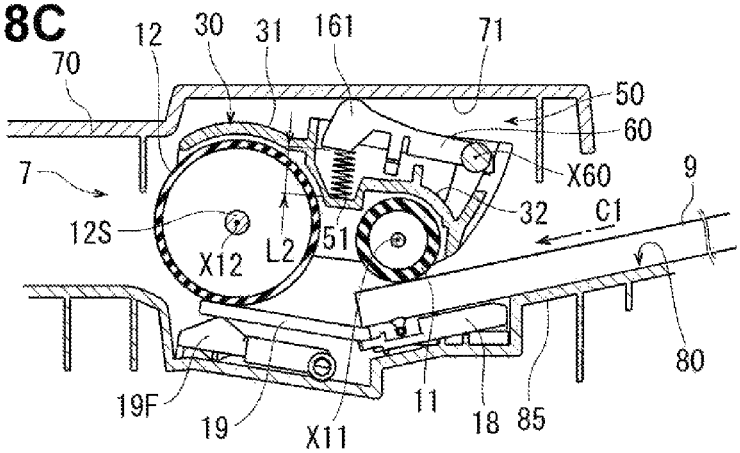

In the image reading apparatus of the comparative example, as illustrated in FIGS. 8A to 8C, the user puts one or more sheets 9 on the sheet supporting portion 80 and inserts a leading edge of the one or more sheets 9 to a position under the first roller 11. Responsively, the first roller 11 is pushed up by the leading edge of the one or more sheets 9, thus causing the holder 30 to swing upwards about the rotation axis X12.

For example, when the number of stacked sheets 9 is one as illustrated in FIG. 8A, the swing axis X60 of the holding member 60 is in the lowermost position. In that state, a length L2 of the spring 51 reaches to the natural length of 10.7 mm. Thus, the entirety of the holding member 60 is spaced away from the wall 71 to the lowermost position in a maximally sloped state. The first contact portion 161 is also spaced from the wall 71 downwards. As a result, the pressing member 50 may not press the first roller 11 supported by the holder 30 toward the sheet supporting portion 80.

As another example, when the number of stacked sheets 9 is twenty-five as illustrated in FIG. 8B, the swing axis X60 of the holding member 60 is moved to an upper level than that in the case of FIG. 8A. Therefore, the entirety of the holding member 60 comes closer to the wall 71. In that state, however, because the first contact portion 161 is just slightly contacted with the wall 71 from below, the length L2 of the spring 51 is not substantially changed from the natural length. Thus, the biasing force of the spring 51 is hardly developed, and the first roller 11 supported by the holder 30 is hardly pressed toward the sheet holding portion 80.

As still another example, when the number of stacked sheets 9 is fifty as illustrated in FIG. 8C, the swing axis X60 of the holding member 60 is moved to an even upper level than in the case of FIG. 8B. Therefore, the entirety of the holding member 60 takes a substantially horizontal posture and comes closest to the wall 71. At that time, the first contact portion 161 is contacted with the wall 71 from below, and the left end side of the holding member 60 and the holder 30 are disposed closer to each other, whereby the length L2 of the spring 51 is compressed to a large extent. In the comparative example, the length L2 of the spring 51 becomes 8.1 mm. In that state, the biasing force of the spring 51 is increased and the first roller 11 supported by the holder 30 is pressed toward the sheet supporting portion 80 by a strong force.

Stated another way, in the image reading apparatus of the comparative example, the pressing force of the pressing member 50 is zero when the number of stacked sheets 9 is from 1 to 24, and it is increased from zero as the number of stacked sheets 9 increases from 25 to 50.

Thus, in the image reading apparatus of the comparative example, the pressing force of the pressing member 50 against the sheet 9 is apt to greatly change depending on the number of stacked sheets 9. This may result in a problem that the sheet 9 may not reliably be conveyed from the sheet supporting portion 80 in the image reading apparatus of the comparative example. When the pressing force applied to the sheet 9 is too weak, for example, there is a possibility of a failure that the sheet 9 is not conveyed from the sheet supporting portion 80.

While the present invention has been described above in connection with the illustrative embodiment, the present invention is not limited to the foregoing illustrative embodiment, and may be carried out by appropriately modifying the illustrative embodiment without departing from the purport of the disclosure.

For example, while the wall 71 is formed in the cover member 70 in the above-described embodiment, the present disclosure is not limited to that construction. The wall may be formed, for example, by an inner wall surface of a housing. Furthermore, the sheet supporting portion may be provided by, e.g., a sheet cassette that is detachably attached to the apparatus main body.

While, in the illustrative embodiment, the length L1 of the spring 51 is maintained constant regardless of the swing of the holder 30 about the rotation axis X12, the present disclosure is not limited to that construction. For example, the shape of the first contact surface 61A or the second contact surface 72A may be modified such that the first contact surface 61A is caused to slide in contact with the second contact surface 72A corresponding to the swing of the holder 30 about the rotation axis X12 in a way of increasing or reducing the length L1 of the spring 51 as appropriate depending on the number of stacked sheets 9.

Aspects of the present disclosure may be applied to, e.g., an image forming apparatus, an image reading apparatus, and a multifunction peripheral.

What is claimed is:

1. A sheet conveyor apparatus comprising:

a sheet support portion configured to support a stack of sheets thereon;

a first roller configured to feed sheets supported on the sheet support portion in a conveyance direction;

a second roller disposed downstream of the first roller in the conveyance direction and configured to be rotatable about a rotation axis extending in a direction perpendicular to the conveyance direction and to separate the sheets one by one;

a holder configured to be supported swingably about the rotation axis and to support the first roller to be rotatable;

a wall disposed opposite to the sheet support portion with the holder interposed therebetween; and a pressing member disposed between the wall and the holder and configured to press the first roller toward the sheet support portion, the pressing member comprising;

a holding member movably supported by the holder to make contact with the wall, wherein one end of the holding member is supported by the holder such that the holding member is swingable about a swing axis and another end of the holding member contacts the wall; and a spring disposed between the holding member and the holder and configured to apply a biasing force that causes the holding member and the holder to move away from each other while maintaining a state in which the holding member contacts the wall regardless of the holder swinging about the rotation axis.

2. The sheet conveyor apparatus according to claim 1, further comprising:

a rotating shaft extending along the rotation axis and configured to be driven to rotate the second roller; and a transmission mechanism disposed in the holder and configured to transmit a rotation driving force of the rotating shaft to the first roller.

3. The sheet conveyor apparatus according to claim 1, wherein the swing axis is disposed closer to the first roller than to the second roller.

4. The sheet conveyor apparatus according to claim 3, wherein an outside diameter of the first roller is smaller than an outside diameter of the second roller.

5. The sheet conveyor apparatus according to claim 1, wherein the holding member comprises a first contact portion projecting toward the wall, the first contact portion having a first contact surface, the wall comprises a second contact portion projecting toward the sheet support portion and having a second contact surface disposed opposite to the first contact portion, the first contact surface is configured to slide in contact with the second contact surface corresponding to the holder swinging about the rotation axis, and the first contact surface and the second contact surface have shapes causing the length of the spring to change in a particular change pattern corresponding to the holder swinging about the rotation axis.

6. The sheet conveyor apparatus according to claim 1, wherein the holding member comprises a first contact portion projecting toward the wall, the first contact portion having a first contact surface, the wall comprises a second contact portion projecting toward the sheet support portion and having a second contact surface disposed opposite to the first contact portion, the first contact surface is configured to slide in contact with the second contact surface corresponding to the holder swinging about the rotation axis, and the first contact surface and the second contact surface have shapes which cause the length of the spring to be kept constant regardless of the holder swinging about the rotation axis.

7. The sheet conveyor apparatus according to claim 1, further comprising a cover configured to be movable between a first position and a second position, wherein in the first position the cover is disposed opposite to the sheet support portion and covers the first roller, the second roller, and the holder, and wherein in the second position the cover is spaced from the sheet support portion to expose the first roller, the second roller, and the holder, and wherein the wall is formed in the cover.

8. The sheet conveyor apparatus according to claim 7, further comprising a pair of positioning portions engaged with the cover at one side and another side thereof in the direction perpendicular to the conveyance direction when the cover is moved to the first position to position the cover, wherein the pressing member is disposed between the pair of positioning portions in the direction perpendicular to the conveyance direction.

9. A sheet conveyor apparatus comprising:

a sheet support portion configured to support a stack of sheets thereon;

a first roller configured to feed sheets supported on the sheet support portion in a conveyance direction;

a second roller disposed downstream of the first roller in the conveyance direction and configured to be rotatable about a rotation axis extending in a direction perpendicular to the conveyance direction and to separate the sheets one by one;

a holder configured to be supported swingably about the rotation axis and to support the first roller to be rotatable;

a wall disposed opposite to the sheet support portion with the holder interposed therebetween; and a pressing member disposed between the wall and the holder and configured to press the first roller toward the sheet support portion, the pressing member comprising;

a holding member movably supported by the holder to make contact with the wall; and a spring disposed between the holding member and the holder and configured to apply a biasing force that causes the holding member and the holder to move away from each other while maintaining a state in which the holding member contacts the wall regardless of the holder swinging about the rotation axis, wherein the holding member comprises a first contact portion projecting toward the wall, the first contact portion having a first contact surface, the wall comprises a second contact portion projecting toward the sheet support portion and having a second contact surface disposed opposite to the first contact portion, the first contact surface is configured to slide in contact with the second contact surface corresponding to the holder swinging about the rotation axis, and the first contact surface and the second contact surface have shapes which cause the length of the spring to be kept constant regardless of the holder swinging about the rotation axis.

10. The sheet conveyor apparatus according to claim 9, further comprising:

a rotating shaft extending along the rotation axis and configured to be driven to rotate the second roller; and a transmission mechanism disposed in the holder and configured to transmit a rotation driving force of the rotating shaft to the first roller.

11. The sheet conveyor apparatus according to claim 9, wherein one end of the holding member is supported by the holder such that the holding member is swingable about a swing axis and another end of the holding member contacts the wall.

12. The sheet conveyor apparatus according to claim 11, wherein the swing axis is disposed closer to the first roller than to the second roller.

13. The sheet conveyor apparatus according to claim 12, wherein an outside diameter of the first roller is smaller than an outside diameter of the second roller.

14. The sheet conveyor apparatus according to claim 9, further comprising a cover configured to be movable between a first position and a second position, wherein in the first position the cover is disposed opposite to the sheet support portion and covers the first roller, the second roller, and the holder, and wherein in the second position the cover is spaced from the sheet support portion to expose the first roller, the second roller, and the holder, and wherein the wall is formed in the cover.

15. The sheet conveyor apparatus according to claim 14, further comprising a pair of positioning portions engaged with the cover at one side and another side thereof in the direction perpendicular to the conveyance direction when the cover is moved to the first position to position the cover, wherein the pressing member is disposed between the pair of positioning portions in the direction perpendicular to the conveyance direction.

* * * * *